United States Patent [19]

Levy et al.

[11] 4,019,260

[45] Apr. 26, 1977

[54] HAIR TREATMENT METHOD AND DEVICE

[75] Inventors: Emanuel Edward Levy, Ridgefield; Martin Jay Wolff, West Haven, both of Conn.

[73] Assignee: Sperry Rand Corporation, Bridgeport, Conn.

[22] Filed: June 4, 1975

[21] Appl. No.: 583,613

[52] U.S. Cl. ..... 34/97; 239/389

[51] Int. Cl.[2] ..... A45D 20/00

[58] Field of Search ..... 219/366, 367, 368, 370, 219/373; 239/101, 102, 389; 34/3, 54, 96, 97, 243 R; 138/46; 415/125; 34/98, 99, 100, 34, DIG. 13, 103

[56] References Cited

UNITED STATES PATENTS

| | | | |
|---|---|---|---|
| 564,906 | 7/1896 | Van Camp | 239/389 |
| 932,618 | 8/1909 | Kunz | 239/389 |
| 1,751,754 | 3/1930 | Overshiner | 219/373 |
| 1,997,387 | 4/1935 | Mc Cord | 34/243 R |
| 2,336,295 | 12/1943 | Reimuller | 415/125 |
| 3,501,846 | 3/1970 | Melega et al. | 34/103 |
| 3,846,047 | 11/1974 | Wada et al. | 34/97 |
| 3,860,174 | 1/1975 | Cercone | 34/97 |
| 3,867,058 | 2/1975 | Hendrickson | 415/125 |

*Primary Examiner*—John J. Camby
*Assistant Examiner*—Larry I. Schwartz
*Attorney, Agent, or Firm*—Charles R. Miranda

[57] ABSTRACT

An improved hair treatment method and device is described which provides for causing pulsatons to occur in an air stream which is utilized for hair treatment. The pulsatons operate to fluff the hair while the hair is simultaneously treated by the air stream.

32 Claims, 11 Drawing Figures

Fig. 3.
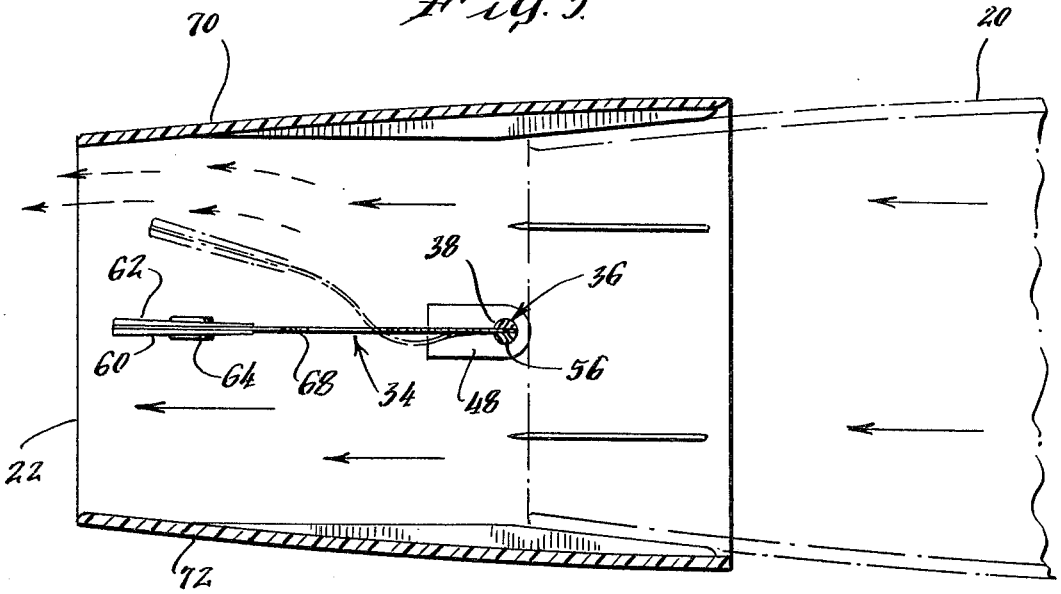
Fig. 6.
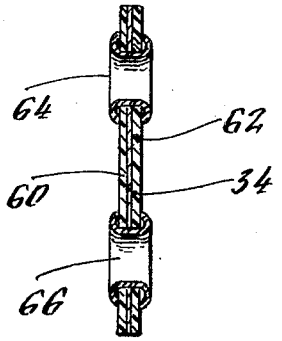
Fig. 4.
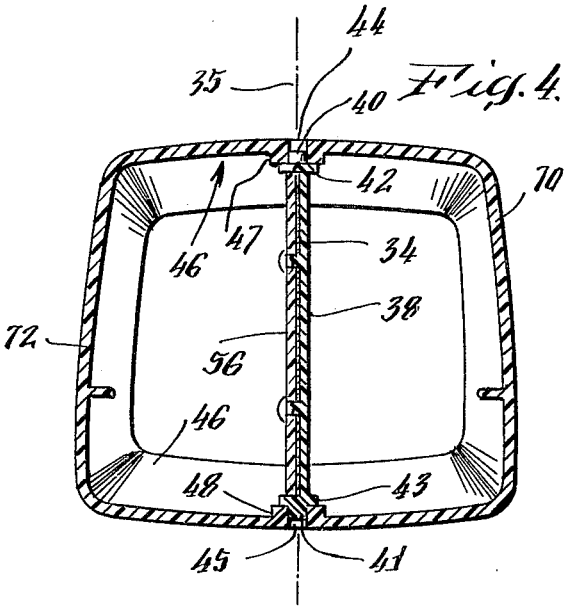
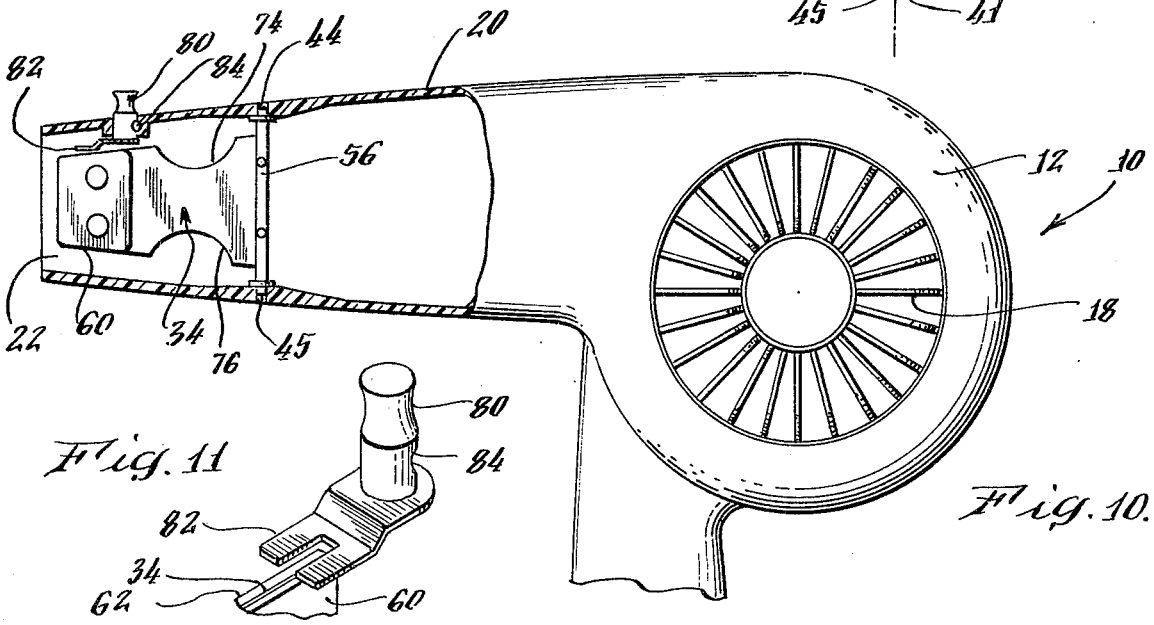
Fig. 11
Fig. 10.

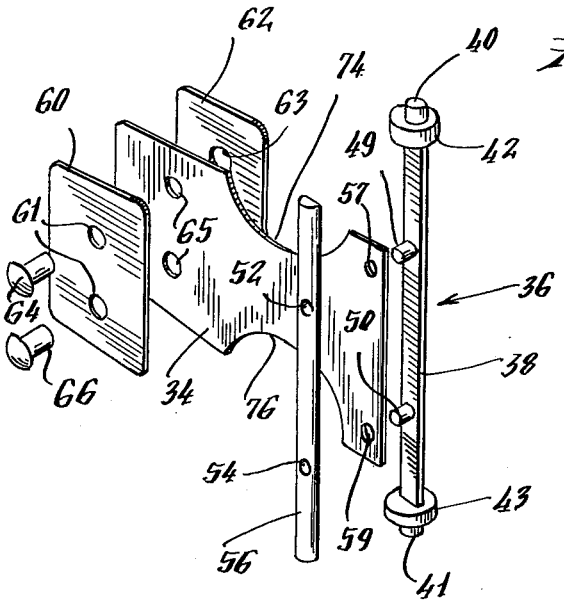
Fig. 5.
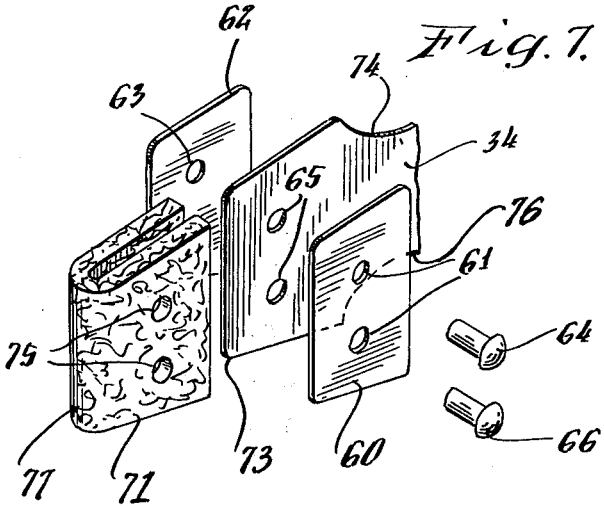
Fig. 7.
Fig. 8.
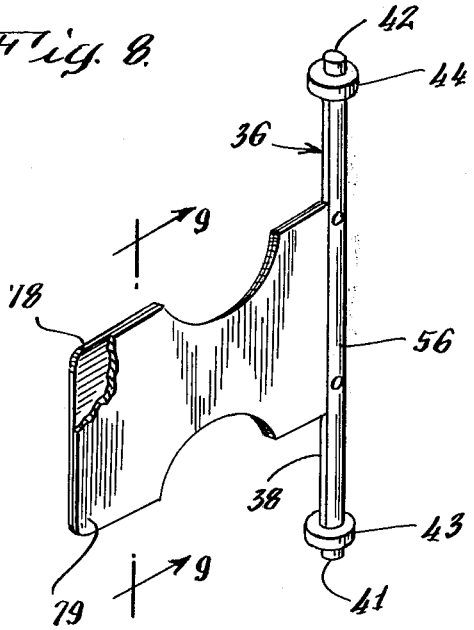
Fig. 9.
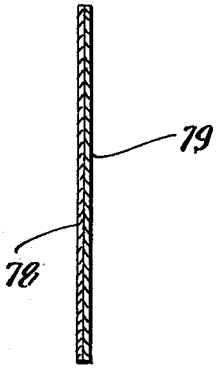

HAIR TREATMENT METHOD AND DEVICE

BACKGROUND OF THE INVENTION

This invention relates to a method and device for the treatment of hair arrangements and more particularly to an improved method and device for styling and drying hair.

In one form of hair treatment, a stream of air is projected at a hair arrangement. The hair arrangement is formed of human, animal or artificial hair and the treatment provides for styling or drying of the arrangement. In styling, an air stream at room temperature or which is warmed slightly is directed at the hair arrangement while in a drying treatment, an air stream which has been heated to a relatively higher temperature is provided. Prior methods and devices have provided this treatment by establishing an air stream in a conduit which includes an outlet shaped for discharging the air stream at the hair arrangement. The outlet may be in the form of a bonnet or it can comprise an outlet aperture of a hand held device. Means are provided for enabling the operator to select the air temperature and thus the treatment mode.

It is desirable that the treatment be accomplished within a reasonably short period of time. In attaining this end, a relatively large mass of air must be delivered to the hair arrangement and, as a result, the velocity of the air stream which is projected at the hair arrangement is relatively high. The relatively high velocity air stream exhibits an undesirable tendency to compact and wad hair strands thereby extending the time necessary for treatment. The treatment can be enhanced by utilizing external means such as combs or brushes to fluff the hair arrangement as the air stream is projected at it. However, this is an undesirable inconvenience which preferably should be limited.

Accordingly, it is an object of the present invention to provide an improved method and device for the treatment of a hair arrangement.

Another object is to provide a hair treatment method and device for automatically fluffing the hair arrangement during treatment.

Another object of the invention is to provide an improved hair dryer.

SUMMARY OF THE INVENTION

In accordance with a feature of this invention, a hair treatment method comprises establishing an air stream in a conduit which includes an outlet for discharging and directing the air stream at a hair arrangement to be treated and periodically varying the magnitude of the air stream flow rate to the outlet thereby causing a pulsating air stream to be projected at the hair arrangement. The air stream provides a relatively large mass of air for treatment while the pulsations thereof simultaneously cause fluffing.

A hair treatment device in accordance with this invention comprises a conduit means which defines a flow path for an air stream and which includes an outlet thereof for discharging and directing the air stream at a hair arrangement and means for establishing an air stream in the conduit. A means is provided for automatically and periodically varying the flow rate of the air stream at the outlet whereby a continuous, air stream having a pulsating flow rate is projected from the outlet.

These and other objects and features of this invention will become apparent with reference to the following specification and to the drawings.

DRAWINGS

In the drawings:

FIG. 3 is a view taken along lines 3—3 of FIG. 2;

FIG. 4 is a view taken along lines 4—4 of FIG. 2;

FIG. 5 is an exploded, perspective view of a flow impedance means of FIG. 1;

FIG. 6 is a fragmentary view partly cut away taken along lines 6—6 of FIG. 2;

FIG. 7 is an exploded, fragmentary perspective view of a flow impedance means constructed in accordance with another embodiment of the invention;

FIG. 8 is a perspective view of a flow impedance means constructed in accordance with a further embodiment of the invention;

FIG. 9 is a fragmentary view taken along lines 9—9 of FIG. 8;

FIG. 10 is a side elevation view, partly cut away and partly in section, illustrating another embodiment of the present invention; and, FIG. 11 is an enlarged, perspective view of a flow impedance enabling and disabling means employed in the embodiment of FIG. 10.

DETAILED DESCRIPTION

Figure 1:
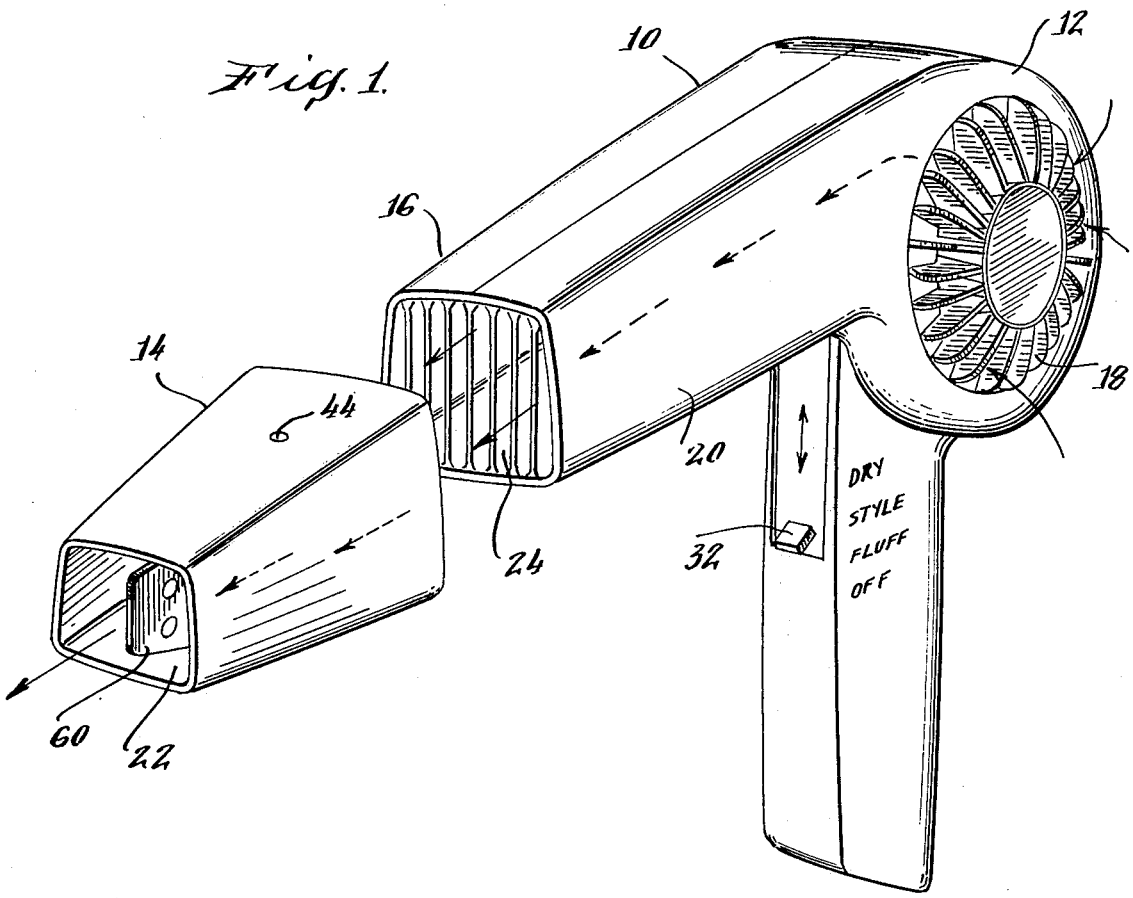
FIG. 1 is an exploded, perspective view of one embodiment of a hair treatment device constructed in accordance with features of this invention.
Figure 2:
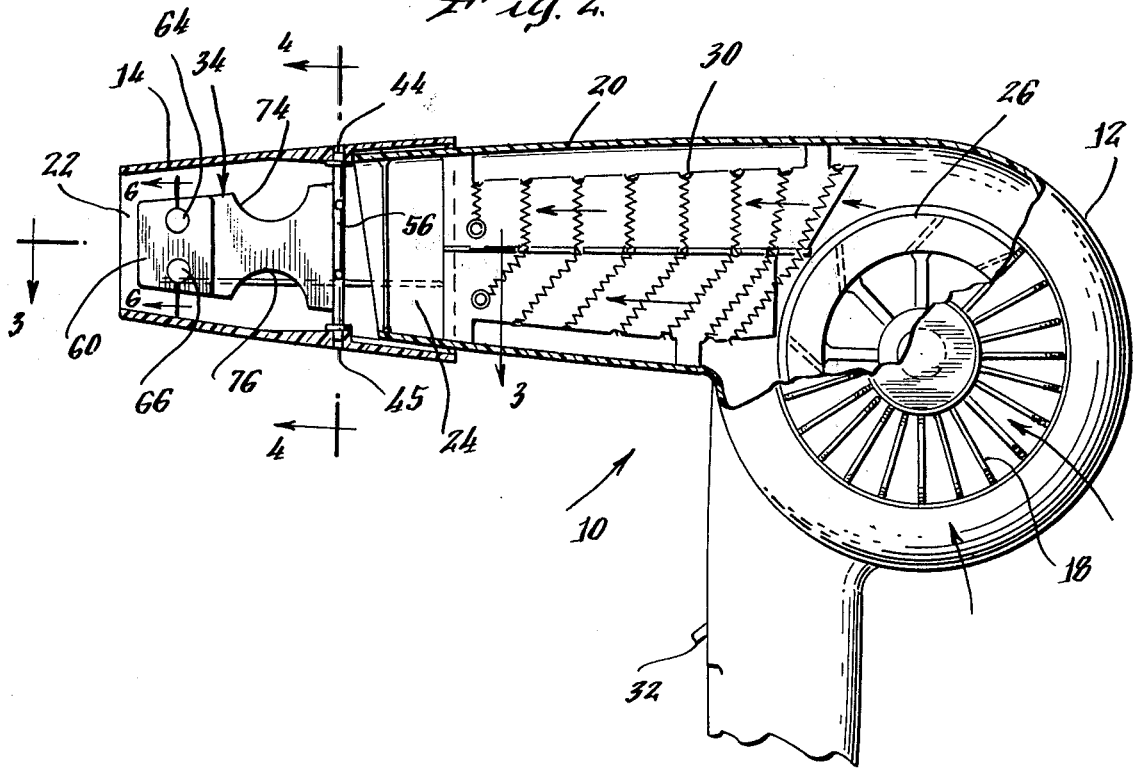
FIG. 2 is a side view, partly in section, of the hair treatment device of FIG. 1.

Referring now to the drawings and particularly to FIGS. 1 and 2, there is illustrated a portable hand held hair treatment device indicated generally by reference numeral 10 which includes a pistol grip shaped housing 12 and a demountable conduit member 14, the purpose of which is described in greater detail hereinafter. The member 14 tapers along its length and is adapted to fit snugly over an outer surface and engage a similar, tapering segment 16 of the housing 12. A latching means not illustrated, may also be employed to supplement or as a substitute for the frictional engagement between member 14 and segment 16.

The housing 12 and the member 14 provide a conduit means which defines a flow path for an air stream. Air conveyed along this path will flow over a course as indicated by the arrows. Air enters the housing 12 through a grill 18 formed in a side wall of the housing and follows a course defined by the inner walls of the housing, through an integral elongated conduit member 20 of generally rectangular cross section, and through the conduit member 14. The air stream is discharged from the conduit means at an outlet aperture 22 of the member 14. The member 14 can be dismounted from the housing 12, and in such case the air stream will discharge from an outlet 24 of the conduit member 20. The air stream which is discharged from the outlet 22 can be directed at localized portions of the hair arrangement being treated.

A means for establishing an air stream in the conduit is provided by an impeller 26 (FIG. 2) which is driven by an electric motor, not illustrated. The impeller 26 is adapted for drawing air in an axial direction and for discharging it in a radial direction. The impeller 26 draws air in an axial direction through the grill 18 and discharges it at a relatively high velocity through the conduit segment 20.

An air stream which is discharged from the impeller 26, is conveyed over a heater assembly 30. The impeller motor and the heater assembly are selectively energized by the user through the operation of a switch 32 which is located on the piston grip handle. This switch can be finger actuated in a vertical direction as viewed in FIG. 1 to a power Off position, and through fluff, style and dry operative positions. In the fluff position, the impeller is actuated while the heater 30 is de-energized thereby discharging an air stream at room temperature from the outlet 22. When the style mode of operation is selected, the heater 30 is also energized to a first energy level at which the air stream which is discharged is warmed to a moderately warm temperature above room temperature. When the user selects the dry mode of operation, the heater 30 is fully energized and the air stream which is discharged by the impeller is heated to a relatively high temperature. A motor speed control, not illustrated, is provided for providing a relatively higher impeller speed at the higher heater operating temperatures.

In accordance with a feature of this invention, a means is provided for automatically and periodically varying the flow rate of the air stream which is discharged at the outlet 22. This means is shown to comprise a variable flow impedance which is formed by an elongated sheet 34 and which is pivotally mounted along a normally vertical transverse axis 35 (FIG. 4) of the conduit. As best seen in FIG. 5, the mounting of the elongated sheet 34 is provided by a pin indicated generally as 36 and which includes an elongated semicircular shaped segment 38. The pin 36 also includes integral, cylindrically shaped segments 40 and 41 which are formed at opposite ends of the segment 38 and integral collar segments 42 and 43. A pair of apertures 44 and 45 (FIG. 4) are formed in the wall 46 of the conduit. These apertures which also extend through integral reinforcing shoulders 47 and 48 respectively are adapted for receiving the cylindrically shaped pin segments 40 and 41 respectively. Surfaces of the collars 42 and 43 are thus positioned in rotatable sliding engagement with surfaces of the shoulders 47 and 48 respectively. The pin 36 (FIG. 5) further includes integrally formed stud segments 49 and 50 which extend through apertures 52 and 54 formed in an elongated, semicircular shaped locking bar 56. These studs are also aligned with a pair of apertures 57 and 59 respectively which are formed in one end of the sheet 34. This apertured end of the sheet is sandwiched between the flat surfaces of the semicircular shaped pin 36 and the locking bar 56 and is maintained in alignment by the studs 49 and 50 which pass through apertures 57 and 59 in the sheet. Both the pin 36 and the locking bar 56 are formed of a plastic material and the assembly is secured together by hot staking the studs 49 and 50. The sheet is thus pivotally mounted in the conduit and is adapted to be deflected by the air stream flowing therein.

A means for effectively increasing the mass of the sheet 34 is provided by a weight assembly which is mounted on an unsupported end of the sheet. As shown in FIGS. 5 and 6, this assembly comprises plastic strips 60 and 62 which sandwich the end of the sheet therebetween. The strips 60 and 62 each include a pair of apertures 61 and 63 respectively which align with a pair of apertures 65 formed near the end of the sheet 34. These weight bodies are secured in a sandwich assembly by eyelets 64 and 66 which extend through the apertures in these bodies and in the sheet 34 and which are set to provide a secured assembly.

In operation, the pivotally mounted sheet 34 and its supported weight assembly is periodically deflected from side to side in the conduit as illustrated in FIG. 3 by a force which is created on its surfaces by the flowing air stream. It is deflected with an oscillatory motion between the inner surfaces of side wall segments 70 and 72 of the conduit. In addition, the sheet is flexible and flexes or bends in a longitudinal direction, i.e., it bends about a transverse axis which is approximately parallel to the axis 35 of the member 14 as illustrated in FIG. 3. This periodically moving sheet operates as a varying flow impedance to the air stream which impedance is caused to vary in magnitude by the air stream which acts upon it. As the sheet transits a central position 68 (FIG. 3) corresponding to a longitudinal axis of the conduit it presents a minimum flow impedance to the air stream. However when it is deflected from this transit position, the sheet restricts the flow of air and the impedance increases until it attains a maximum value when the assembly makes its maximum transverse excursion. The flow restriction as illustrated in FIG. 3, for example, causes a partial increase in flow velocity through a portion of the conduit thereby resulting in a variation in the flow rate of the air stream which is discharged from the aperture 22. The air stream which is thus discharged exhibits periodically recurring pulsations in the magnitude of its flow rate.

The pulsating air stream which is discharged at the aperture 22 provides an advantageous result in the treatment of hair arrangements. As previously indicated, a relatively high velocity stream of relatively uniform discharge velocity exhibits a tendency to compact and wad hair strands necessitating correction by the use of auxiliary accessories, such as combs and brushes. This is particularly true in a drying mode of hair treatment. However, the pulsations in the flow rate which are provided by the method and device described herein is found to provide the desired treatment and to cause a simultaneous agitation and fluffing of the hair strands as the air stream is discharged toward the hair arrangement. This simultaneous agitation and fluffing is beneficial in that it reduces the time required for a drying treatment and provides desired handling of the hair arrangement in a styling mode. The treatment is thus advantageous and reduces the time and additional steps necessary in providing the treatment of the hair arrangement.

The variable flow impedance thus described can be modified in accordance with the invention to satisfy various operating requirements. Although the sheet 34 is pivotally mounted and resembles an air vane which would appear to deflect in the direction of air flow, the oscillations experienced by the sheet 34 are believed to be initiated and sustained by air turbulence occurring in the conduit in cooperation with the flexible characteristics of the sheet 34. The sheet 34 is formed of a material which is adapted to flex or bend in a longitudinal direction about a transverse axis. One such preferred material comprises a polyester film such as MYLAR having a thickness of about 0.003 inch. flexibility of the sheet is further enhanced as illustrated in FIGS. 2 and 5 by the use of width constrictions 74 and 76 which are formed at opposite edges of the sheet and at a generally centrally located position along the length of the sheet.

The sheet and weight assembly can be considered to be a Spring-Mass-Damper system that has a dynamic response to a Forcing-Function. The sheet 34 represents a spring and has a specific spring rate (K). It also acts as a damper with an internal damping rate (C). The weights 60 and 62 are mechanically attached to the "spring-damper" combination and oscillate in a particular pattern when driven. The driving function, $f(t)$ is an air pulse which is not rigidly connected to the system and is subject to turbulence due to the heater assembly in the air path. The system boundry for lateral displacements of the sheet are the inside walls 70 and 72 of the conduit segment 14. This defines the condition of maximum excursion ($\bar{x}$). Because of the limiting boundries for displacement, there is a collision between the weights and walls twice per cycle. The following general form of differential equation defines the interrelationships between various operating parameters.

$$W/g\,\ddot{X} + C\,\dot{X} + K\,X = f(t) - g(t)$$

where:

W = Weight (LBS) of weight members 60 and 62 and the weight of sheet 34.

C = Damping rate of sheet 34 (LB − SEC)/FT

K = Spring Rate (LB/FT)

$f(t)$ = Forcing function of air $g(t)$ = Secondary forcing function as defined by system boundry (conduit walls)

G = Gravity (32Ft/Sec/Sec)

The geometrical dimensions of the sheet 34 can be varied to satisfy particular requirements. A relatively elongated sheet 34 may be provided which can be operated without the weight means. In this case the entire oscillatory mass is provided by the sheet itself. However, the greater length of such a sheet can be impractical in that a conduit to accommodate this sheet must be of relatively extended dimensions. In general, the sheet can be made more stiff or less flexible as the length of the sheet is increased. The arrangement disclosed in the drawings is particularly advantageous in that the desired oscillations of the sheet 34 are attained with practical limitations and dimensions in length.

In general, the weight means 60 and 62 are provided for establishing an oscillatory mass within practical dimensions. The magnitude of the mass is dependent upon the mass of the sheet 34 and thus the length of this sheet for a particular air stream velocity. The magnitude of the mass is also selected for controlling the oscillatory rate of deflection of the sheet 34.

In a particular arrangement which is not deemed limiting in any respect, the sheet 34 was formed of MYLAR polyester film having a thickness of 0.003 inch, a length of about 2 inches, a width of 1¼ inches at the supported end which tapered to a width of about 0.83 inch at an opposite end thereof. The weight means comprises a pair of polycarbonate sheets having a thickness of 0.020 inch, a length of about 0.073 inch and a width of about 0.98 inch which tapered to a width of about 0.83 inch. The ratio of the masses of the weight means 60 and 62 to the sheet 34 was about 4:1. An impeller was employed having 28 blades and was operated at a fan speed of about 7,800 rpm. The sheet 34 oscillated at a rate of about 800 cycles per minute thus providing a periodic variation in the flow rate of the air stream discharged from the conduit at the same rate.

It is preferable that the sheet 34 be pivotally mounted along a normally vertical, transverse axis of the conduit such as the axis 35 (FIG. 3). The sheet can also be mounted along a normally horizontal transverse axis of the conduit 14. In this case, however the air stream must create a force for overcoming gravitational effects operating on the combined mass of the sheet and weight assembly.

In the alternative embodiment of the variable impedance means illustrated in FIG. 7, a sound damping means is provided for quieting physical contact between the impedance and the side wall segments 70 and 72. The damping means comprises a damping body 71 formed from a sheet of relatively soft, resilient material such as foam rubber or foam plastic which is folded into a U-shaped configuration. The damping body includes two pair of apertures 75 which are formed therein. It is folded and is positioned near a distal edge 73 of the sheet 34 and is secured in assembly with sheet 34 and the sheets 60 and 62 by the eyelets 64 and 66 which extend through the aligned apertures of these bodies. A segment 77 of the damping body 71 is positioned slightly forward of the sheets 60 and 62 and makes contact with the side walls 70 and 72 during the deflection of the impedance. This contact is relatively quiet because of the soft, resilient characteristic of the material from which body 71 is formed.

There is illustrated in FIGS. 8 and 9, an alternative embodiment of the variable impedance means which provides for relatively silent operation and which also eliminates the use of the weight sheets 60 and 62 which were described with respect to the embodiment of FIG. 1. This embodiment provides an impedance mass by the use of a pair juxtaposed sheets 78 and 79 which are secured by the pin 36 and the locking bar 56 in the same manner as is illustrated in FIG. 5. Thus, desired flexibility in the impedance means sheets is provided under relatively quiet operating conditions without the use of weights.

At times it may be desirable to provide hair treatment with a continuous flow of air from the conduit. The device illustrated in FIGS. 1–5 can be modified by dismounting the conduit segment 14 from the conduit segment 20 thus permitting discharge of the air stream from the aperture 24. The conduit segment 14 thus also advantageously comprises an adapter for the hair treatment device for providing enhanced treatment.

FIG. 10 illustrates an alternative embodiment of the invention wherein the variable air flow impedance means is mounted in a segment of the conduit which is integral with the housing 12. Those elements of FIG. 10 performing functions similar to elements described with respect to FIGS. 1 through 5 bear the same reference numerals. A means is provided for enabling and disabling the operation of the variable flow impedance. This means comprises a button 80 which extends through an aperture formed in the upper wall of the conduit 20. A member having a bifurcated extension 82 is secured to a lower surface of the button 80. When the button 80 is located in a depressed position, the bifurcated extension is positioned about the weight means 60, 62 and inhibits movement thereof, thus disabling operation of the variable flow impedance. However, withdrawal of the button 80 to an upper position frees the weight means 60, 62 from the bifurcated extension and permits the sheet 34 to oscillate within the conduit. The button 80 is secured in the enabling or disabling positions by a detenting means 84.

There has thus been described an improved method and device for the treatment of hair arrangements by projecting an air stream at the hair arrangement. The method and device provides for the discharge of a pulsating air stream which treats the hair and simultaneously operates to fluff the arrangement. This feature is provided by a relatively non-complex flow impedance which is automatically actuated by the flow of the air stream.

While there have been described particular embodiments of the invention, it will be apparent to those skilled in the art that variations may be made thereto without departing from the spirit of the invention and the scope of the appended claims.

We claim:

1. An adaptor for attachment to a hair treatment device having a housing therefor including a conduit segment and means for establishing an air stream which flows from an aperture of said conduit segment, comprising:

a. a conduit body having an outlet, said conduit body adapted to be mounted to the conduit segment of said hair treatment device at said conduit segment aperture whereby the air stream of the hair treatment device flows through said conduit body; and, b. flow impedance means within the air stream for automatically and periodically varying the flow rate of the air stream at said conduit body outlet whereby a continuous air stream having a pulsating flow rate is discharged from the outlet.

2. The device of claim 1 wherein said flow impedance means for varying the flow rate comprises a flow impedance within the conduit body and said flow impedance varies in magnitude upon actuation of the impedance means.

3. The device of claim 2 wherein said flow impedance means is automatically actuated by the air stream.

4. The device of claim 3 wherein said flow impedance means comprises a sheet which is positioned in the conduit body and means are provided for mounting said sheet in the air stream for deflection of the sheet by the air stream.

5. The device of claim 4 wherein said sheet comprises an elongated body and means are provided for supporting said elongated body at one end thereof.

6. The device of claim 5 wherein said sheet has a transverse axis and the sheet is flexible about said transverse axis.

7. An improved device for the treatment of a hair arrangement by the projection of an air stream at the hair arrangement comprising:

a. a conduit defining a flow path for an air stream, said conduit having an outlet for discharging and directing an air stream at a hair arrangement which is to be treated;

b. means for establishing in the conduit an air stream which is discharged from the conduit at said outlet; and c. a flow impedance within the conduit which varies in magnitude upon automatic actuation by the air stream for automatically and periodically varying the flow rate of the air stream at the outlet whereby a continuous air stream having a pulsating flow rate is discharged from the outlet.

8. The device of claim 7 wherein said impedance comprises first and second sheets which are positioned in the conduit and means are provided for mounting said sheets in juxtaposition for deflection of the sheets by the air stream.

9. The device of claim 7 wherein said flow impedance comprises a sheet which is positioned in the conduit and means are provided for mounting said sheet at the air stream for deflection of the sheet by the air stream.

10. The device of claim 9 wherein said conduit has transverse axis thereof and the sheet is supported along said axis.

11. The device of claim 9 wherein said axis comprises a normally vertically oriented transverse axis.

12. The device of claim 9 wherein said conduit includes a demountable conduit member and the sheet is supported in said demountable conduit member.

13. The device of claim 9 including means for selectively inhibiting the deflection of the sheet wherein the device selectively discharges a pulsed or unpulsed air stream.

14. The device of claim 9, including a sound damping body and means are provided for mounting said sound damping body to a distal segment of the sheet.

15. The device of claim 14 wherein said sound damping body is formed of a soft, resilient material.

16. The device of claim 9 including a weight for increasing the effective mass of the sheet in the air stream.

17. The device of claim 16 wherein said weight has a mass which is greater than the mass of the sheet and means for mounting the weight to the sheet.

18. The device of claim 17 wherein said sheet comprises an elongated body which is supported near one end thereof and the weight is mounted to the sheet at an opposite unsupported end of the sheet for movement therewith.

19. The device of claim 9 wherein said conduit includes a wall and means mounted to said wall and positioned within the conduit for supporting the sheet in the conduit.

20. The device of claim 19 wherein said sheet mounting means provides pivotal mounting of the sheet at one end thereof.

21. The device of claim 9 wherein said sheet comprises an elongated body and means are provided for supporting said elongated body at one end thereof.

22. The device of claim 21 wherein said sheet has a transverse axis and the sheet is flexible about said transverse axis.

23. The device of claim 22 wherein said sheet has a width thereof and a constriction is formed in the sheet for increasing flexibility of the sheet about the transverse axis.

24. The device of claim 23 wherein said sheet comprises an elongated body and the constriction is located at an intermediate position along the length of said elongated body.

25. The device of claim 23 wherein said constriction is centrally located along the length of the elongated body.

26. The device of claim 23 wherein said constriction is semicircular shaped and is formed along an edge of the sheet.

27. In a portable, hand-held hair dryer having an air stream conduit, a blower means for establishing an air stream in said conduit, and means for heating the air stream, the improvement comprising:

a. an elongated sheet of flexible material, and b. means for supporting said sheet along a normally vertical transverse axis of the conduit, the sheet having a surface area and an effective mass for causing periodic deflection of the sheet by said air stream between walls of the conduit whereby a pulsating air stream is discharged from the conduit.

28. An improved method for the treatment of a hair arrangement by the projection of an air stream at the hair arrangement comprising the steps of:

a. establishing an air stream in a conduit, said conduit having an outlet thereof for discharging and directing said air stream at a hair arrangement which is to be treated; and, b. periodically varying the magnitude of the air stream flow rate at said outlet by periodically varying the magnitude of flow impedance presented to the air stream in the conduit whereby a pulsating air current is discharged from the outlet for projection at a hair arrangement to be treated.

29. The method of claim 28 wherein said flow impedance is provided by a sheet positioned in the conduit, said sheet having a surface thereof and the magnitude of the impedance is varied by periodically altering the position of the surface in the air stream.

30. The method of claim 29 including the step of causing the air stream to periodically deflect and alter the position of the sheet in the air stream.

31. The method of claim 28 including the step of heating the air stream.

32. An improved method for drying a hair arrangement by the projection of warm air at said hair arrangement comprising the steps of:

a. establishing an air stream in a conduit, said conduit having an outlet thereof for discharging and directing said air stream at a hair arrangement which is to be treated;

b. conveying the air stream in the conduit to a heater for heating the air stream;

conveying the heated air stream in the conduit toward a sheet which is positioned in the conduit and is adapted to be deflected by the air stream and to periodically vary a flow impedance which is presented to the air stream by said sheet, whereby a heated, pulsating stream of air is discharged from said outlet.

* * * * *